United States Patent [19]

Davies

[11] Patent Number: 4,540,346

[45] Date of Patent: Sep. 10, 1985

[54] DIAPHRAGM PUMPS

[75] Inventor: Anthony R. Davies, Cirencester, England

[73] Assignee: VFP Fluid Power Limited, United Kingdom

[21] Appl. No.: 509,954

[22] Filed: Jun. 30, 1983

[30] Foreign Application Priority Data

Jul. 5, 1982 [GB] United Kingdom ..... 8219415

[51] Int. Cl.[3] ..... F04B 35/02

[52] U.S. Cl. ..... 417/273; 417/383

[58] Field of Search ..... 417/273, 383, 388

[56] References Cited

U.S. PATENT DOCUMENTS

| | | | |
|---|---|---|---|
| 2,624,284 | 1/1953 | Straub | 417/388 |
| 2,711,697 | 6/1955 | Gibbs | 417/274 |
| 3,000,320 | 9/1961 | Ring | 417/383 |
| 3,030,892 | 4/1962 | Riccardo | 417/383 |
| 3,134,508 | 5/1964 | Bayer et al. | 417/383 |
| 3,168,045 | 2/1965 | Seabastiani | 417/383 |
| 3,257,952 | 6/1966 | McCormick | 417/383 |
| 3,508,845 | 4/1970 | Strassburger | 417/388 |
| 4,443,160 | 4/1984 | Berthold | 417/383 |

FOREIGN PATENT DOCUMENTS

| | | | |
|---|---|---|---|
| 1133628 | 5/1958 | Fed. Rep. of Germany | 417/388 |
| 637589 | 5/1950 | United Kingdom | 417/478 |
| 1400150 | 11/1971 | United Kingdom . | |
| 2054752 | 2/1981 | United Kingdom . | |
| 530958 | 3/1977 | U.S.S.R. | 417/383 |

*Primary Examiner*—William L. Freeh

*Attorney, Agent, or Firm*—Wood, Dalton, Phillips, Mason & Rowe

[57] ABSTRACT

A diaphragm pump is disclosed which includes flow channels (12;12*a*) within pressure chambers (9;9*a*), at least one of the walls defining the flow channels being in the form of a diaphragm wall (16,17; 16*a*,17*a*). A driven piston (A;B) displaces a liquid within the pressure chambers (9;9*a*) to cause cyclical changes in the volume of and pressure subsisting within the flow channels. Compensating pistons (S;T) are disposed generally opposite each of the driven pistons (A;B) and the compensating pistons are connected to a common hydraulic circuit such that the compensating pistons remain in position until the pressure in one of the pressure chambers (9;9*a*) exceeds a predetermined pressure, whereupon the compensating pistons (S;T) react in a manner tending to prevent further rise in the pressure in that chamber.

7 Claims, 1 Drawing Figure

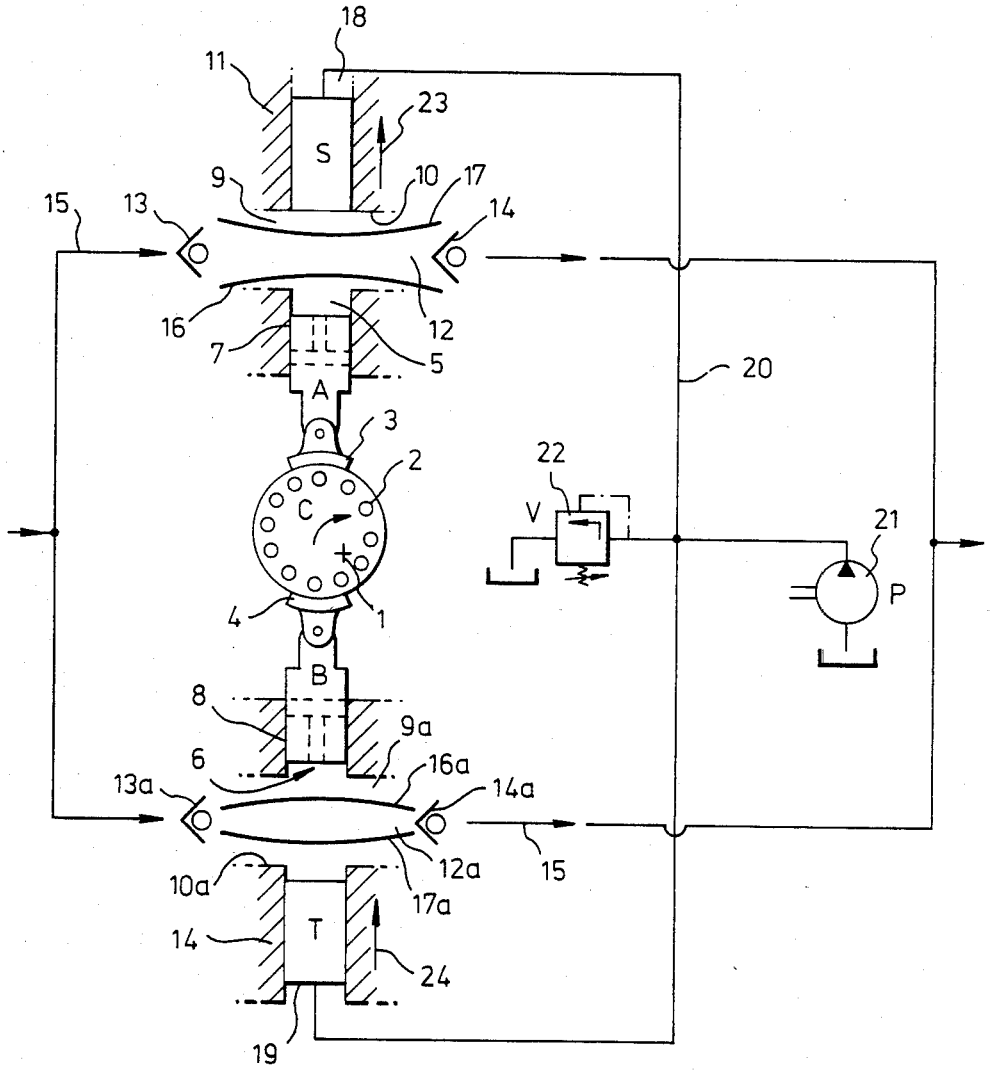
18
11
23
S
9
10
17
15
13
14
16
12
7
5
A
20
3
2
22
V
C
21
P
4
1
B
8
9a
6
16a
13a
14a
12a
15
10a
17a
T
14
24
19

DIAPHRAGM PUMPS

BACKGROUND OF THE INVENTION

This invention relates to diaphragm pumps and, more particularly, is concerned with an arrangement permitting variable delivery by limiting the pressure in the flow channels of such pumps.

Numerous designs of diaphragm pumps are available. For example, British Patent Specification No. 1,400,150 describes and claims a diaphragm pump having a tubular body, a tubular diaphragm received by the tubular body and defining with it a pressure chamber, and a piston and cylinder arrangement in communication with the pressure chamber. The piston is reciprocable in the cylinder, and one way valves adjacent the respective ends of the diaphragm serve to control flow of fluid through the pump's flow channel. Liquid is displaced between the pressure chamber and the cylinder when the pump is in operation, this displacement causing the cross-sectional area of the tubular diaphragm to vary thereby varying the volume and the pressure within the diaphragm to cause displacement of liquid therethrough. Such a pump is able to pump liquids such as water at relatively high pressures such as, for example, 5000 pounds per square inch (350 kg/cm$^2$).

The present invention is concerned with a pump which functions in a manner analogous to that described in British Patent Specification No. 1,400,150. The invention aims to obviate or at least to ameliorate a disadvantage associated with pumps of this sort, namely that the pressure in the flow channel of the pump may rise to unacceptably high levels and that delivery from the pump is not easy to control.

SUMMARY OF THE INVENTION

According to the present invention, there is provided a diaphragm pump assembly comprising a drive shaft; a plurality of cylinders whose axes are spaced about the drive shaft axis; a piston received by each cylinder for reciprocating movement therewithin; a plurality of pressure chambers defined by the internal surfaces of a body and adapted to be filled with a pressurised fluid; a flow channel disposed within each of the pressure chambers, each flow channel being bounded by at least one diaphragm wall and having a one-way inlet valve and one-way outlet valve, the arrangement being such that, in use, rotation of the drive shaft causes reciprocation of the pistons within their respective cylinders thereby displacing fluid in the pressure chambers and causing cyclical changes in the volume of and the pressure subsisting within the respective flow channels, characterised in that: (1) a plurality of compensating pistons are provided in said body, each compensating piston being associated with a respective pressure chamber, flow channel and main piston; (2) the face of each compensating piston remote from its respective pressure chamber is subject, in use, to the action of a hydraulic circuit including a control pump, the hydraulic circuit being common to all the compensating pistons and being adjustable so that the hydraulic pressure in the circuit can be set to a predetermined value; and (3) said hydraulic circuit is arranged so that the compensating pistons are held in position by the predetermined hydraulic pressure until the pressure in one of the pressure chambers exceeds said predetermined pressure, whereupon the compensating pistons react in a manner tending to prevent any further rise in the pressure in said one pressure chamber.

DESCRIPTION OF THE PREFERRED EMBODIMENTS

Preferably, the flow channels of the diaphragm pump are defined by flexible diaphragm walls formed of a rubbery material.

The bodies defining the pressure chambers can be tubular in form, as can the diaphragm walls which define the flow channels within the pressure chambers.

The means for reciprocating the pistons may include an eccentric member secured to the drive shaft and an annular member, or a segmented annular member, coaxial with the eccentric and rotatably mounted thereon, the pistons being coupled to the annular member or to the segments of the annular member. The pistons themselves are preferably disposed equi-angularly about the axis of the drive shaft.

The control pump in the hydraulic circuit linking the compensating pistons can be associated with an adjustable relief valve which enables the pressure in the hydraulic circuit to be set at a predetermined value.

BRIEF DESCRIPTION OF THE DRAWING

The drawing shows a schematic cross-sectional view through part of a diaphragm pump in accordance with the present invention.

DETAILED DESCRIPTION OF THE DRAWING

The invention will now be described in greater detail with reference to the accompanying drawing.

Referring now to the drawing, the diaphragm pump includes a drive shaft having an axis 1 which carries an eccentric 2. Located about the eccentric 2 is an annular ring which is divided into eight segments two of which are illustrated and are given reference numerals 3 and 4. Each of the annular segments is pivotally connected to a piston such as A or B reciprocable within a cylinder such as 5 or 6 defined by walls 7 or 8, respectively. Thus there are eight pistons, although only two of these pistons A and B are illustrated in the drawing. The pistons are arranged equi-angularly around the axis 1. Each piston is associated with a discrete, fluid-tight pressure chamber such as 9 or **9*a* defined between the internal walls 10, 10*a* of a body 11. Disposed within each of the pressure chambers there is a flow channel such as 12 or 12*a* which is bounded by diaphragm walls such as 16 and 17 for flow channel 12 and 16*a* and 17*a* for flow channel 12*a*. The diaphragm walls are formed of a natural or synthetic rubber material. When assembled and ready for use, each of the pressure chambers 9 of the diaphragm pump will be filled with a fluid such as oil. Opposite ends of each flow channel are provided with one way inlet and outlet valves such as 13 and 14, respectively. A source of the fluid which is to be driven through the diaphragm pump is connected to inlet valves such as 13 and 13*a* and the reciprocating movement of the pistons such as A and B acts on the fluid within the pressure chambers such as 9 and 9*a* to cause displacement of the liquid through the flow channels in the direction of arrows 15. The diaphragm walls which make up the flow channels can be in the form of two tubular diaphragms held generally concentrically within body 11 and clamped at the boundaries of each pressure chamber. Another arrangement is to use a clamped toroidal tube as the element defining the flow channels. The inlet valves such as 13 and 13*a* can be fed from a common source such as an annulus (not shown) located over the pressure chambers such as 9, 9***a*. In an alternative embodiment, each flow channel is discrete and held within its respective pressure chamber.

A compensating piston is mounted in a wall of each body 11 facing the outer diaphragm wall (e.g. 17) of each flow channel (e.g. 12). Two such compensating pistons are shown in the drawing and are designated S and T. It will thus be seen that each of the pressure chambers (e.g. 9) is associated with two pistons (e.g. A and S) between which there is disposed a flow channel (e.g. 12) having flexible walls (e.g. 16 and 17) and one-way valves (e.g. 13 and 14).

The remote faces 18 and 19 of compensating pistons S and T, respectively, i.e. those faces of the compensating pistons furthest from their respective pressure chambers 9 and 9*a*, are acted upon by a hydraulic circuit indicated as line 20 which in turn is connected to a control pump 21. An adjustable relief valve 22 is also provided in the hydraulic circuit.

In operation, rotation of the drive shaft about its axis causes rotation of eccentric 2 which in turn drives the main pistons (such as A and B) in a radial manner, thereby pumping oil into the sealed pressure chambers 9 so as cyclically to compress the diaphragm walls (e.g. 16 and 17). The action of one way valves (e.g. 13 and 14) ensures that the cyclical compression of the diaphragm walls results in conveyance of the pumped fluid through the flow channels (e.g. 12) in the direction of arrows 15. In the drawing, piston A is shown in its advancing state, in which oil is being pumped into the chamber 9 adjacent piston A, while piston B is shown on its return stroke, where it decompresses its adjacent pressure chamber 9*a* thus allowing a liquid, e.g. water, to be drawn into the flow channel 12*a* through its inlet valve 13*a*. It will be appreciated that restriction of the fluid outlet by the closing of valve 13 and the resisting pressure on valve 14 in the upper flow channel 12 raises the pressure within channel 12 and hence raises the pressure of oil in pressure chamber 9. When the pressures on opposite sides of valve 14 are approximately equal, valve 14 will open to permit discharge of the said liquid. The properties of the rubber diaphragms such as 16 and 17 are such that the oil and pumped fluid pressures are essentially the same throughout the operating cycle of the pump.

Relief valve 22 is adjusted so that the hydraulic fluid in circuit 20 is maintained, by control pump 21, at a predetermined pressure which may be, for example, 100 bar. The pumping of a liquid through the flow channels (e.g. 12) will continue unaffected by the compensating pistons provided that the pressure within the pressure chambers (e.g. 9) does not exceed the predetermined pressure in hydraulic circuit 20. Any demand for a liquid pressure within the flow channels higher than the pressure in circuit 20 will result in movement of the compensating pistons. Thus if the demand for liquid pressure within channel 12 exceeds the pressure in circuit 20, compensating pistons will move outwardly in the direction of arrow 23 thus displacing hydraulic fluid in circuit 20. This in turn will cause compensating piston T to move inwards in the direction of arrow 24, thus displacing oil into the adjacent pressure chamber 9*a* and exerting work on piston B. Thus the flow of hydraulic fluid displaced by compensating piston S is effectively absorbed by compensating piston T. Under this compensating condition, shaft torque is required to power piston A in the same manner as when full outputflow is being produced; the basic mechanism also acts as a motor for piston B, thereby applying torque to the drive shaft and hence closing an internal power loop.

Adjustment of the setting of relief valve 22 will alter the compensating pressure established within hydraulic circuit 20.

As well as the pressure compensation described above, the use of compensating pistons arranged in hydraulic circuits as described is expected to afford other advantages including an increased bearing life, increased diaphragm life (since deflection is reduced during compensation) and an improved cooling capability, caused by the inbuilt circulation flow due to the control pump 21.

If it is desired to operate the diaphragm pump with high compensation pressure settings, the faces such as 18 and 19 of the compensating pistons can be stepped, so that hydraulic circuit 20 acts on a larger area of the compensating pistons than that exposed to pressure chambers 9. In this way, the control pump 21 can be operated at a pressure which is considerably less than the pressure at which the diaphragm pump compensates to prevent any further rise in the pressure of the liquid being pumped through the flow channels of the pump, the ratio between the pressure in circuit 20 and the maximum liquid delivery pressure being equal to the area ratio of the stepped compensating pistons.

I claim:

1. An improved diaphragm pump assembly of the type comprising a drive shaft (1); a plurality of cylinders (5;6) whose axes are spaced about the drive shaft axis (1); a piston (A;B) received by each cylinder (5;6) for reciprocating movement therewithin; a plurality of pressure chambers (9;9*a*) defined by internal surfaces (10; 10*a*) of a body (11) and adapted to be filled with a pressurized liquid; a flow channel (12; 12*a*) disposed within each of the pressure chambers, each flow channel being bounded by at least one resilient, deflectable, diaphragm wall (16, 17; 16*a*, 17*a*) and having a one-way inlet valve (13; 13*a*) and a one-way outlet valve (14; 14*a*), the arrangement being such that, in use, rotation of the drive shaft causes reciprocation of the pistons within their respective cylinders thereby displacing liquid in the pressure chambers and causing cyclical changes in the volume of and pressure subsisting within the respective flow channels, the improvement comprising:

first and second compensating pistons (S;T) in said body (11), each compensating piston being associated with a respective pressure chamber (9;9*a*), flow channel (12;12*a*) and main piston (A:B);

hydraulic circuit means establishing hydraulic communication between first and second faces, respectively located on each of the first and second compensating pistons remote from its respective pressure chamber, and cooperatively interconnecting the first and second compensating pistons so that movement of either of the first and second compensating pistons effects a reactive movement of the other of the first and second compensating pistons;

hydraulic control means including a control pump (21), common to the first and second compensating pistons (S;T) to create an adjustable, predetermined reference hydraulic pressure in the hydraulic circuit means so that the compensating pistons are held in a first position by the predetermined hydraulic pressure and in the event that the liquid pressure in one of the pressure chambers (9;

9*a*) exceeds said predetermined pressure, to automatically move one of the compensating pistons from said first position in a manner tending to prevent any further rise in the pressure in said one pressure chamber and in response thereto cause movement of the other of the compensating pistons, whereby pressure above the pedetermined, reference pressure is absorbed by the compensating pistons so as not to unduly stress the diaphragm walls associated with the first and second compensating pistons.

2. A pump as claimed in claim 1, wherein the flow channels within the pump are defined by flexible diaphragm walls formed of a rubbery material, said diaphragm walls (16,17; 16*a*, 17*a*) are tubular in form, said one diaphragm wall bounding each flow channel resides in a pressure chamber and liquid in each pressure chamber transmits pressure from the diaphragm walls to one of the compensating pistons and upon said fluid pressure exceeding said predetermined value causes said one piston to move from the first position.

3. A pump as claimed in claim 1, wherein said body (11) is tubular in form.

4. A pump as claimed in claim 1, characterised in that the means for reciprocating the pistons includes an eccentric member (2) secured to the drive shaft and an annular member, or a segmented annular member (3;4), co-axial with the eccentric and rotatably mounted thereon, the pistons being coupled to the annular member or to the segments of the segmented annular member.

5. A pump as claimed in claim 4, characterised in that the pistons (A;B) are disposed equi-angularly about the axis (1) of the drive shaft.

6. A pump as claimed in claim 4, characterised in that the control pump (21) in the hydraulic circuit means (20) is associated with an adjustable relief valve (22) which enables the pressure in the hydraulic circuit means (20) to be set at predetermined value.

7. A pump as claimed in claim 5 characterized in that the control pump (21) in the hydraulic circuit means (20) is associated with an adjustable relief valve (22) which enables the pressure in the hydraulic circuit means (20) to be set at a predetermined value.

* * * * *